US007918200B2

(12) United States Patent
Nguyen

(10) Patent No.: US 7,918,200 B2
(45) Date of Patent: Apr. 5, 2011

(54) SHEET STEEL ROCKER ARM

(75) Inventor: Van Hau Nguyen, Fürth (DE)

(73) Assignee: Schaeffler KG, Herzogenaurach (DE)

( * ) Notice: Subject to any disclaimer, the term of this patent is extended or adjusted under 35 U.S.C. 154(b) by 433 days.

(21) Appl. No.: 12/087,934

(22) PCT Filed: Dec. 21, 2006

(86) PCT No.: PCT/EP2006/070092

§ 371 (c)(1),
(2), (4) Date: Jul. 29, 2008

(87) PCT Pub. No.: WO2007/082622

PCT Pub. Date: Jul. 26, 2007

(65) Prior Publication Data

US 2009/0007870 A1 Jan. 8, 2009

(30) Foreign Application Priority Data

Jan. 21, 2006 (DE) ..... 10 2006 002 996

(51) Int. Cl.
*F01L 1/18* (2006.01)

(52) U.S. Cl. ..... 123/90.39; 123/90.44; 123/90.16; 74/559

(58) Field of Classification Search ..... 123/90.39, 123/90.44, 90.16; 74/559; 29/888.2
See application file for complete search history.

(56) References Cited

U.S. PATENT DOCUMENTS

| | | | | |
|---|---|---|---|---|
| 3,045,657 | A | 7/1962 | Sampietro | |
| 4,682,575 | A | 7/1987 | Simko | |
| 4,762,099 | A | 8/1988 | Fujii | |
| 4,913,104 | A | 4/1990 | Mills | |
| 6,672,266 | B2 * | 1/2004 | Okubo et al. | 123/90.39 |

FOREIGN PATENT DOCUMENTS

| | | | |
|---|---|---|---|
| DE | 197 10 867 | A1 | 9/1998 |
| DE | 696 13 477 | T2 | 4/2002 |
| DE | 102 97 309 | T5 | 10/2004 |
| DE | 103 40 944 | A1 | 4/2005 |
| EP | 1 119 689 | B1 | 1/2004 |
| JP | 05 272310 | | 10/1993 |
| JP | 05 272310 | A | 10/1993 |
| JP | 2003-041 910 | A | 2/2003 |
| JP | 2003-056 314 | A | 2/2003 |

* cited by examiner

*Primary Examiner* — Zelalem Eshete
(74) *Attorney, Agent, or Firm* — Charles A. Muserlian

(57) ABSTRACT

A rocker arm (1) made of thin-walled sheet steel which rocker arm is intended for a suspended arrangement together with other like rocker arms under a girder-like carrier (2) of a valve train of an internal combustion engine, the rocker arm having an inverted U-shaped profile, a support (7) for a gas exchange valve is formed on one end (6) of an underside (5) of a crossbar (4) of the rocker arm, an upper side (9) of the crossbar (4) is stamped in the region of the support (7) by a stamping and extrusion molding method toward the underside (5), so that an M-like cross-section with a longitudinal channel (10) formed on the upper side (9) is obtained and at its other end (11), the rocker arm (1) has a fork-shaped, open configuration and merges into a region (12) which is angularly bent towards the underside (5) and on which a roller (13) forming a cam contacting surface is arranged, said rocker arm (1) of this type possesses, among other things, an excellent stiffness, is simple to manufacture and has a small design height requirement.

11 Claims, 3 Drawing Sheets

SHEET STEEL ROCKER ARM

This application is a 371 of PCT/EP2006/070092 filed Dec. 21, 2006.

FIELD OF THE INVENTION

The invention concerns a rocker arm made of thin-walled sheet steel for pivotable, suspended arrangement under a girder-like carrier of a valve train of an internal combustion engine, said rocker arm having an inverted U-shaped cross-section, a support for a gas exchange valve being arranged on one end of an underside of a crossbar of the rocker arm, and a roller forming a cam contacting surface being arranged on another end. The invention further concerns a girder-like carrier on which a row of rocker arms of the pre-cited type are suspended.

BACKGROUND OF THE INVENTION

A rocker arm of the pre-cited type is disclosed in EP 1 119 689 B1, see, for example, FIGS. 2-6. This rocker arm is likewise mounted for pivoting by suspension under a girder-like carrier of a valve train of an internal combustion engine. A drawback of this prior art, considered to be generic, is that the rocker arm possesses inadequate stiffness, particularly in the region of the valve stem support but also over its entire length. Its manufacture and assembly also prove to be relatively complex because, for example, a separate, crosswise extending support member for the valve stem is provided on the one end. For fixing the support member, the side walls have to be provided with separate recesses. Besides this, it is noted that the crossbar of this rocker arm, as viewed in longitudinal direction, extends behind the region of the roller forming the cam contacting surface. Due to its substantially "straight" shape, where necessary, the rocker arm must be made with relatively large dimensions.

OBJECT OF THE INVENTION

The object of the invention is therefore to provide a rocker arm and a girder-like carrier with at least one rocker arm suspended thereon, in which the aforesaid drawbacks are eliminated.

SUMMARY OF THE INVENTION

The invention achieves this object with the novel features of claim 1. In particular, the rocker arm, or the at least one rocker arm fixed on the carrier, has an M-like cross-section on the one end, which cross-section is preferably (not compulsorily) generated through a stamping and extrusion molding method. At the same time, at the other end on which the roller is arranged, the rocker arm has a fork-shaped open configuration and is angularly bent toward the underside.

With these measures, the aforesaid drawbacks are eliminated. The rocker arm is simple to manufacture and its stiffness is improved in comparison with the cited prior art. It is precisely through the stamping and extrusion molding method used for creating the M-shaped support that the rocker arm has excellent stiffness properties in this region and, where appropriate, it can be made with thinner walls.

In addition, material is also saved through the fork-shaped open angular bend on the other end on which the roller is arranged. The angular bend creates an additional increase of stiffness. The rocker arm also possesses an improved mass moment of inertia compared to the rocker arm discussed above because less mass is accumulated away from the fulcrum.

Further advantageous measures form the subject matter of dependent claims that, each one alone or in combination with further claims, can also contain patentable features.

According to claim 2, the angular bend on the other end is advantageously so large that an axial line of the roller is situated below an imaginary prolongation of undersides of the side walls.

According to a further advantageous development of the invention, the crossbar has a substantially smooth-faced, closed configuration and therefore ends in front of the angularly bent portion. The crossbar can comprise at least one recess for fixing a spring clip therein. However, it is also conceivable to provide a plurality of longitudinally spaced apart recesses in the crossbar or in the side walls that lead to a reduction of mass. If need be, a person skilled in the art will assure an adequate stiffness of the rocker arm by providing suitable beadings/stiffening ribs etc.

The longitudinal channel created by the stamping and extrusion molding process in the upper side of the crossbar must be made narrower than a distance between inner surfaces of the side walls situated under the longitudinal channel. Advantageously, this longitudinal channel has straight side walls and a flat bottom surface. Thus, through this measure, a particularly stiff valve stem support is created in a simple manner. The stamping and extrusion molding step can be integrated into the actual punching and bending operation while making the rocker arm which can be executed, for example, in a plurality of drawing steps on an automatic punching and bending machine.

According to a further proposal of the invention, for achieving a simple mounting of the rocker arm on the girder-like carrier, a semi-spherical cavity is arranged in an upper side of the crossbar. This also makes it possible to fix, preferably, a clip in this region with which the respective rocker arm can be fixed by suspension for pivoting on a head piece projecting out of the carrier. This creates a simple possibility of pre-assembling the carrier with the head pieces and the (preferably) like rocker arms fixed thereon. The entire device can thus be kept in stock in a completely pre-assembled state for subsequent installation by the engine manufacturer.

Assembly is performed as follows: the respective rocker arm with the pre-assembled spring clip, whose recess is situated on top of the semi-spherical cavity, is pressed over the head piece projecting out of the carrier so that the recess of the spring clip engages into an undercut in the head piece.

According to a further advantageous feature of the invention, the roller must project beyond the other end of the rocker arm and beyond the upper and the underside of the side walls. This results in an additional saving of material.

It is also possible to make the rocker arm narrower in the region of its ends than in its central region near the cavity. Thus, the design space requirement of the rocker arm in sideward direction is also relatively small. It will also be clear to the person skilled in the art that the narrower end regions of the rocker arm lead to a saving of mass, so that the mass moment of inertia can be reduced.

The roller on the one end can be mounted through a rolling bearing (preferably, a needle roller bearing) but equally well also through a sliding bearing on a pin whose ends are fixed in the side walls in the angularly bent region. If more appropriate, it is also conceivable and intended to provide a sliding contact for the cam in the angularly bent region.

The subject matter of the invention likewise includes a girder-like carrier on which the aforesaid rocker arms are fixed by suspension through their spring clips. The respective head piece for each rocker arm may either be a component of a pressure piston of a hydraulic lash adjuster or a component of a mechanical lash adjuster.

BRIEF DESCRIPTION OF THE DRAWINGS

The invention is appropriately described in more detail below with reference to the appended drawings.

DETAILED DESCRIPTION OF THE DRAWING

Figure 1:
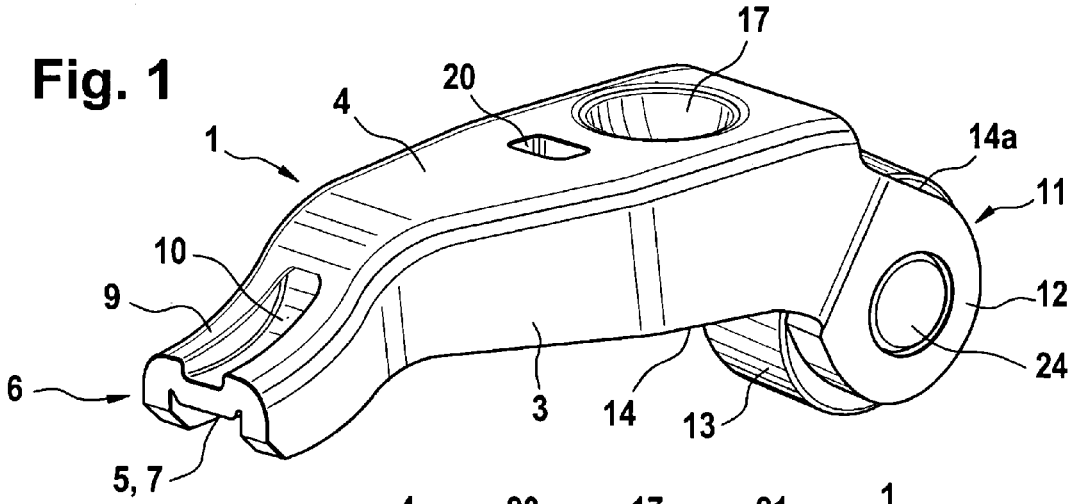
FIG. 1 is a perspective view of a rocker arm of the invention.
Figure 2:
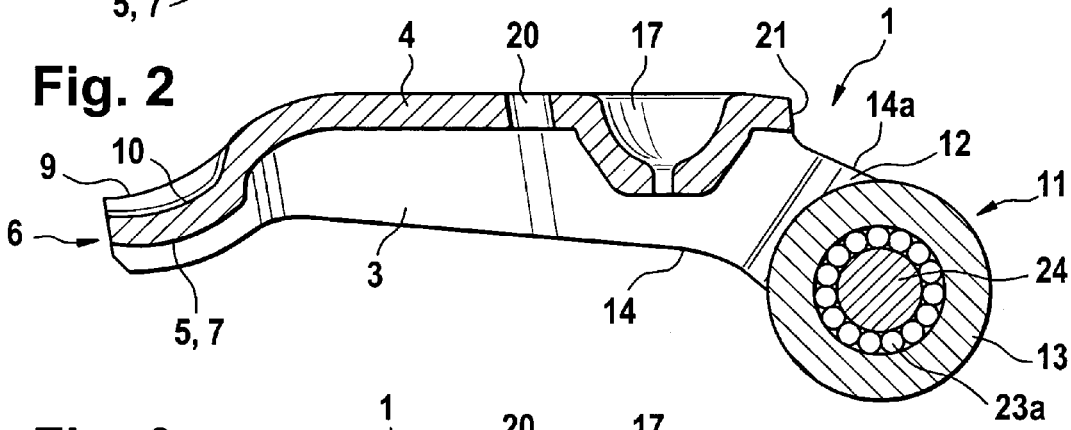
FIG. 2 shows a longitudinal section through the rocker arm of the invention.

The drawing discloses a rocker arm 1 made of thin-walled sheet steel. The rocker arm 1 is intended for a suspended arrangement on a girder-like carrier 2 of a valve train of an internal combustion engine (see also FIGS. 5 and 6). The rocker arm 1 generally comprises two longitudinally extending side walls 3 that are connected on their upper side 9 through a crossbar 4. The rocker arm 1 thus generally forms an inverted U-shaped profile in cross-section.

In the region of one end 6, the rocker arm 1 comprises on an underside 5 of its crossbar 4, a support 7 for a gas exchange valve. In this region, the rocker arm 1 possesses an M-like cross-sectional profile (see FIG. 4). This profile is preferably created by a stamping and extrusion molding method in which, inter alia, a stamping die of the entire tool engages the upper side 9 of the crossbar 4 on the one end 6, so that this upper side 9 is progressively stamped toward the underside 5 and a longitudinal channel 10 starting directly from the one end 6 is thus formed in the upper side 9. Said profile of the support 7 can be generated during the non-chipping production of the rocker arm 1 in large series (automatic cutting and bending machine). The region of the support 7 possesses excellent stiffness properties.

Figure 3:
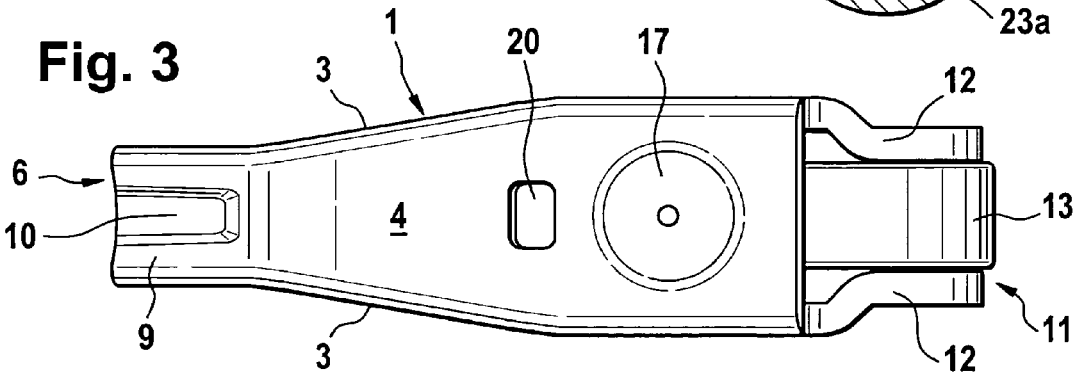
FIG. 3 is a top view of the rocker arm of the invention.

As further disclosed (see, for example FIG. 3), the largest width of the rocker arm 1 is in the central region of the rocker arm 1. The crossbar 4 comprises on its upper side 9, a semi-spherical cavity 17 through which the rocker arm 1, as disclosed in FIGS. 5 and 6, can be arranged indirectly for pivoting on a carrier 2 (s. below).

On another end 11, the rocker arm 1 comprises a region 12 that is bent angularly downward. In the present example of embodiment, this region 12 has a fork-shaped, open configuration, so that the crossbar 4 ends approximately in front of the angularly bent region 12. Fixed in this region 12, in the side walls 3, is a pin 24 on which a roller 13 for a low-friction cam contact is arranged through a rolling bearing 23*a*. Due to said angularly bent region, the stiffness of the rocker arm 1 is additionally enhanced.

Figure 4:
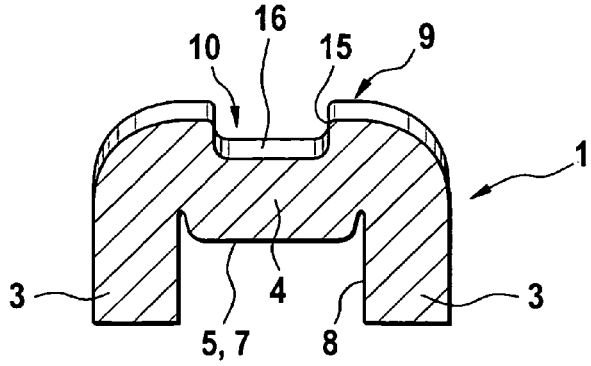
FIG. 4 shows a cross-section through the rocker arm of the invention in a region of a support.

As can be seen in the detail illustrated in FIG. 4, the longitudinal channel 10 formed during the stamping and extrusion molding step in the upper side 9 of the crossbar 4 has vertical side walls 15 and a flat bottom surface 16. The region thus stamped through can have the same thickness as the rest of the crossbar, but may also be thicker or thinner.

Figure 5:
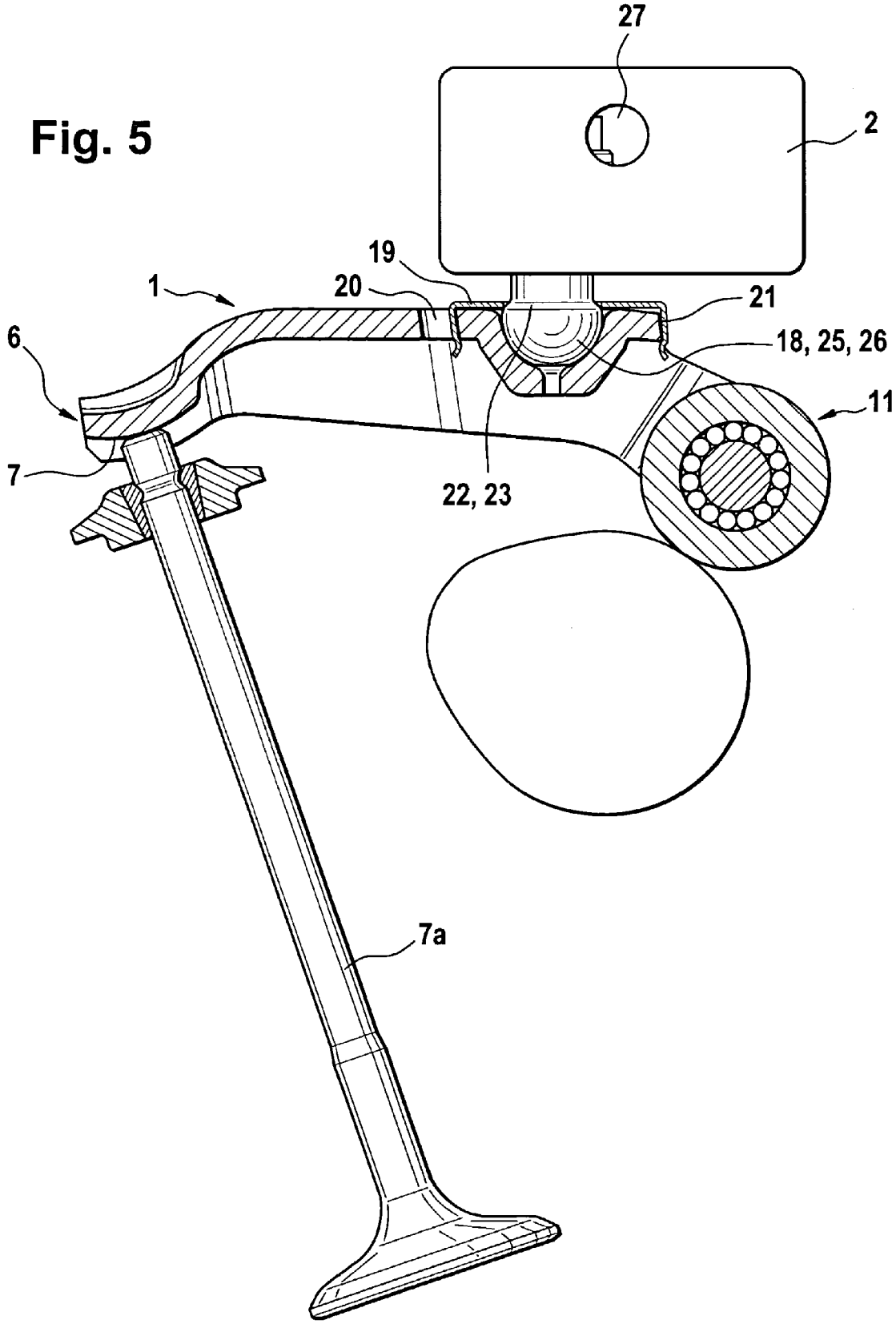
FIG. 5 shows a girder-like carrier with a rocker arm suspension-mounted thereon, and a hydraulic lash adjuster.
Figure 6:
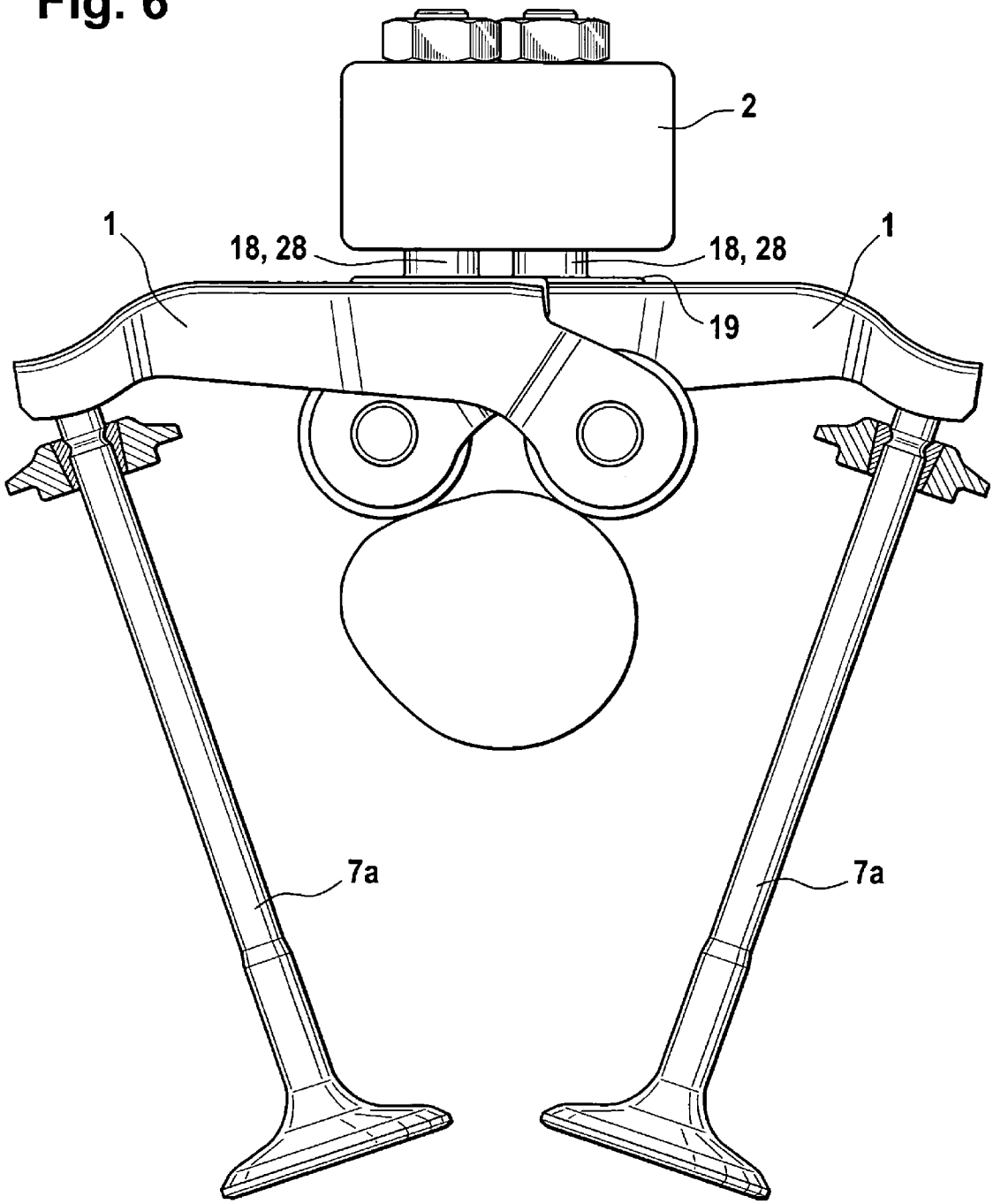
FIG. 6 shows a carrier system similar to the aforesaid structure but with two rows of suspended rocker arms and a mechanical lash adjuster.

One side of a spring clip 19 is fixed in the recess 20 in the crossbar 4 shown in FIG. 1 (see also, FIGS. 5 and 6). Another side of the spring clip 19 is "hooked" over a front end 21 of the crossbar 4 in front of the angularly bent region 12.

The spring clip 19 comprises a recess 22 above the cavity 17. For a pivotal fixing of the rocker arm 1 on the corresponding head piece 18 of the carrier 2, the rocker arm 1 must be placed with the spring clip 19 over the head piece 18 in such a way that the recess 22 of the spring clip 19 snaps into an undercut 23 of the respective head piece 18. This leads to the creation of a simple, articulated and inseparable pre-assembly of the rocker arm 1 on the carrier 2 situated above the rocker arm 1. However, other types of articulated and inseparable connections of the rocker arm 1 to the carrier 2 are also conceivable.

According to FIG. 5, the head piece 18 is a component of a pressure piston 25 of a hydraulic lash adjuster 26. A row of pressure pistons 25 extend downward from the carrier 2, so that respective rocker arms 1 can be pivotally mounted through clips on each pressure piston 25. A supply of hydraulic medium to the hydraulic lash adjusters 26 can be realized through a longitudinal channel 27 intersecting these.

According to FIG. 6, the lash adjuster is a mechanical lash adjuster 28. The respective head piece 18 has a bolt-like configuration and is a component of the mechanical lash adjuster 28 that needs no further description in the present context. This solution differs from that of FIG. 5 by the fact that two rows, preferably, of like rocker arms 1 oriented away from each other are arranged on one carrier 2.

The invention claimed is:

1. A rocker arm made of thin-walled sheet steel for pivotable, suspended arrangement under a girder carrier of a valve train of an internal combustion engine, said rocker arm comprising two side walls that, together with a crossbar which connects the side walls, form a substantially inverted U-shaped profile, a support for a gas exchange valve being arranged on one end of an underside of the crossbar, inner surfaces of the side walls forming guide sections, an upper side of the crossbar in a region of the support being stamped toward the underside, so that an M-like cross-section comprising a longitudinal channel on the upper side is formed, the rocker arm merging at another, fork-shaped open end (11) into an angularly bent region that is bent toward the underside, and a roller forming a cam contacting surface arranged in the angularly bent region wherein the crossbar has a substantially smooth-faced, closed configuration extending from the one end up to the angularly bent region on the other end.

2. A rocker arm of claim 1, wherein the region at the other end of the rocker arm is bent, so that an axial line of the roller is situated on or under an imaginary prolongation of undersides of the side walls.

3. A rocker arm of claim 1, wherein the longitudinal channel in the upper side of the crossbar on the one end comprises substantially vertical side walls and a flat bottom surface.

4. A rocker arm of claim 1, wherein the crossbar comprises on the upper side, between the ends, a semi-spherical cavity for arrangement on a head piece projecting from the carrier.

5. A rocker arm of claim 4, wherein the cavity is overlapped by a thin-walled spring clip for mounting the rocker arm on the head piece of the carrier, the spring clip is hooked at one end into a recess of the crossbar and a another end, onto a front end of the crossbar on the angularly bent region, and the spring clip comprises a recess, by choice, spring tongues that engage during mounting into an undercut of the head piece.

6. A rocker arm of claim 1, wherein the roller projects beyond the other end and beyond an upper side and an under side of the side walls.

7. A rocker arm of claim 4, wherein a largest width of the rocker arm is situated in a region of the semi-spherical cavity in the crossbar, and the rocker arm is narrower or tapered in a region of the ends of the rocker arm.

8. A rocker arm of claim 1, wherein the roller is arranged through one of a rolling bearing or a sliding bearing on a pin whose ends extend in the side walls in the angularly bent region.

9. A girder carrier of claim 1, comprising at least one row of rocker arms arranged on said carrier.

10. A girder carrier of claim 4, wherein the head piece for each rocker arm is a component of a pressure piston of a hydraulic lash adjuster that can be loaded by hydraulic medium through at least one longitudinal channel extending through the carrier.

11. A girder carrier of claim 4, wherein the head piece for each rocker arm is a component of a mechanical lash adjuster.

* * * * *